US007591447B2

(12) United States Patent
Hammer et al.

(10) Patent No.: US 7,591,447 B2
(45) **Date of Patent: *Sep. 22, 2009**

(54) WALL BLOCK, SYSTEM AND MOLD FOR MAKING THE SAME

(75) Inventors: James Hammer, Fircrest, WA (US); Llewellyn Lee Johnston, Vancouver, WA (US)

(73) Assignee: Westblock Systems, Inc., Salem, OR (US)

( * ) Notice: Subject to any disclaimer, the term of this patent is extended or adjusted under 35 U.S.C. 154(b) by 806 days.

This patent is subject to a terminal disclaimer.

(21) Appl. No.: 10/931,485

(22) Filed: Aug. 31, 2004

(65) Prior Publication Data

US 2005/0108973 A1 May 26, 2005

Related U.S. Application Data

(63) Continuation-in-part of application No. 10/273,631, filed on Oct. 18, 2002, now Pat. No. 7,328,537, and a continuation-in-part of application No. 10/091,039, filed on Mar. 4, 2002, now Pat. No. 7,100,886.

(60) Provisional application No. 60/344,549, filed on Oct. 18, 2001.

(51) Int. Cl.
*B28B 11/08* (2006.01)

(52) U.S. Cl. ..... 249/104; 249/162; 425/385; 425/470

(58) Field of Classification Search ..... 249/52, 249/63, 140, 142, 160, 161; 425/385, 436 R, 425/441, 470
See application file for complete search history.

(56) References Cited

U.S. PATENT DOCUMENTS

| | | | |
|---|---|---|---|
| 378,356 | A | 2/1888 | Cohen |
| 1,219,127 | A | 3/1917 | Marshall |
| 1,727,363 | A | 9/1929 | Bone |

(Continued)

FOREIGN PATENT DOCUMENTS

| | | |
|---|---|---|
| AT | 4473 | 7/2001 |

(Continued)

OTHER PUBLICATIONS

Statement of James Hammer Regarding Prior Sales , 2006.

(Continued)

*Primary Examiner*—Yogendra Gupta
*Assistant Examiner*—Thu Khanh T Nguyen
(74) *Attorney, Agent, or Firm*—Klarquist Sparkman, LLP

(57) ABSTRACT

A wall block comprises an upper surface spaced apart from a substantially parallel lower surface, opposed first and second faces, and opposed side surfaces converging between respective ends of the first and second faces. Blocks in a wall may be stacked on top of each other in either a vertical, set forward or set backward relationship. A three-block system for constructing walls includes a small, medium, and large block, each having two differently sized faces that can serve as the exposed face on one side of a wall. The small, medium, and large blocks can be manufactured using a single mold that is configured to provide a roughened texture resembling natural stone on two opposing faces of each block.

8 Claims, 11 Drawing Sheets

U.S. PATENT DOCUMENTS

| | | | | |
|---|---|---|---|---|
| 2,225,612 | A | 12/1940 | Allen | |
| 2,235,646 | A | 3/1941 | Schäffer | |
| 2,963,828 | A | 12/1960 | Belliveau | |
| 3,036,407 | A | 5/1962 | Dixon | |
| 3,609,926 | A | 10/1971 | Muse | |
| 3,936,987 | A | 2/1976 | Calvin | |
| 3,940,229 | A | 2/1976 | Hutton | |
| 3,981,953 | A | 9/1976 | Haines | |
| 4,016,693 | A | 4/1977 | Warren | |
| 4,093,174 | A | 6/1978 | Mullins | |
| 4,110,949 | A | 9/1978 | Cambiuzzi et al. | |
| 4,228,628 | A | 10/1980 | Schlomann | |
| 4,524,551 | A | 6/1985 | Scheiwiller | |
| 5,078,940 | A | 1/1992 | Sayles | |
| 5,161,918 | A | 11/1992 | Hodel | |
| 5,217,630 | A | 6/1993 | Sayles | |
| RE34,314 | E | 7/1993 | Forsberg | |
| 5,257,880 | A | 11/1993 | Janopaul, Jr. | |
| 5,417,523 | A | 5/1995 | Scales | |
| 5,537,796 | A | 7/1996 | Kliethermes, Jr. | |
| 5,540,525 | A | 7/1996 | Miller et al. | |
| 5,568,994 | A | 10/1996 | Dawson | |
| 5,595,460 | A | 1/1997 | Miller et al. | |
| 5,711,130 | A | 1/1998 | Shatley | |
| 5,722,386 | A | 3/1998 | Fladgard et al. | |
| 5,771,631 | A | 6/1998 | Dawson | |
| 5,816,749 | A | 10/1998 | Bailey, II | |
| 5,848,511 | A | 12/1998 | Scales | |
| 5,858,511 | A | 1/1999 | Lisowsky | |
| 5,879,603 | A | 3/1999 | Sievert | |
| 5,984,589 | A | 11/1999 | Ciccarello | |
| 6,019,550 | A | 2/2000 | Wrigley et al. | |
| 6,024,517 | A | 2/2000 | Castonguay et al. | |
| 6,035,599 | A | 3/2000 | Sonnentag | |
| 6,113,379 | A | 9/2000 | LaCroix et al. | |
| 6,115,983 | A | 9/2000 | Poignard | |
| 6,138,983 | A | 10/2000 | Sievert | |
| 6,149,352 | A | 11/2000 | MacDonald | |
| 6,159,401 | A | 12/2000 | Hoesch | |
| 6,209,848 | B1 | 4/2001 | Bolles et al. | |
| 6,224,815 | B1 | 5/2001 | LaCroix et al. | |
| 6,464,199 | B1 * | 10/2002 | Johnson | 249/117 |
| 6,615,561 | B2 | 9/2003 | MacDonald et al. | |
| 6,827,527 | B2 | 12/2004 | Conkel et al. | |
| 6,854,231 | B2 | 2/2005 | MacDonald et al. | |
| 6,893,192 | B2 | 5/2005 | MacDonald | |
| 6,912,823 | B2 | 7/2005 | MacDonald et al. | |
| 6,960,048 | B2 | 11/2005 | Blomquist et al. | |
| 6,978,580 | B1 * | 12/2005 | Clark et al. | 52/311.1 |
| 7,114,887 | B1 * | 10/2006 | Rainey | 405/262 |
| 2002/0001509 | A1 | 1/2002 | Hong | |
| 2002/0083657 | A1 | 7/2002 | Mattox et al. | |
| 2003/0002925 | A1 | 1/2003 | Blomquist et al. | |
| 2003/0070383 | A1 | 4/2003 | Heinle | |
| 2003/0074856 | A1 | 4/2003 | Hammer | |
| 2003/0164574 | A1 | 9/2003 | Hammer et al. | |

FOREIGN PATENT DOCUMENTS

| | | |
|---|---|---|
| EP | 0 170 113 A1 | 7/1985 |
| FR | 2.216.823 | 8/1974 |
| GB | 2 127 872 A | 4/1984 |
| JP | 07-052133 | 2/1995 |
| JP | 2001-191314 | 7/2001 |
| WO | WO 01/57333 | 8/2001 |

OTHER PUBLICATIONS

Photographs of a "softsplit mold," pp. 1-3 (in use prior to 2002).
Office Action from the United States Patent & Trademark Office in co-pending U.S. Appl. No. 11/032,994, dated Jan. 15, 2009.
Notice of Allowance from the United States Patent & Trademark Office in co-pending U.S. Design Appl. No. 29/289,849, dated Mar. 5, 2009.

* cited by examiner

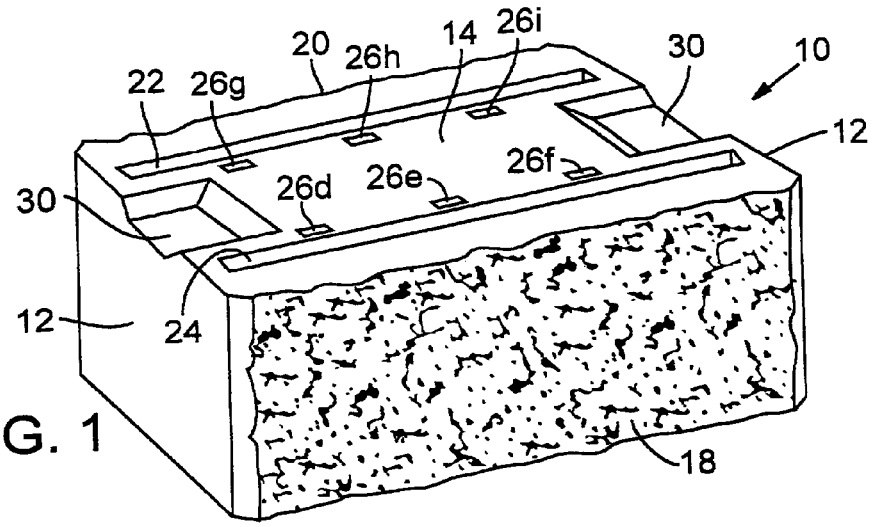
FIG. 1
FIG. 2
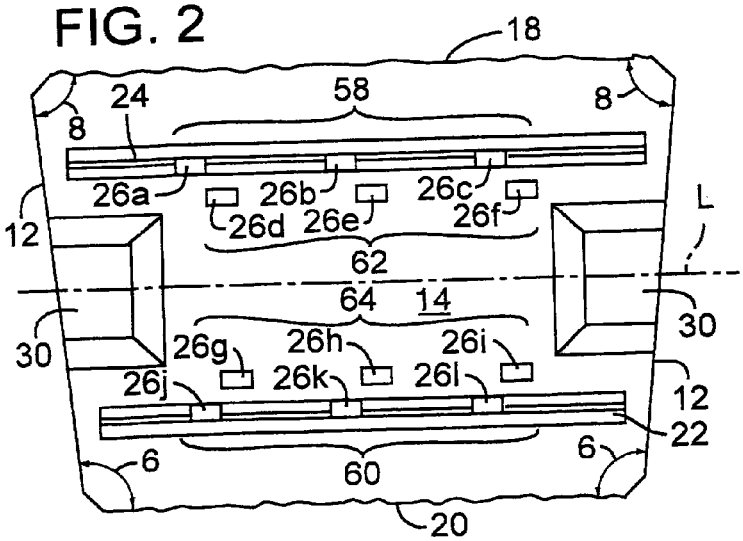
FIG. 3
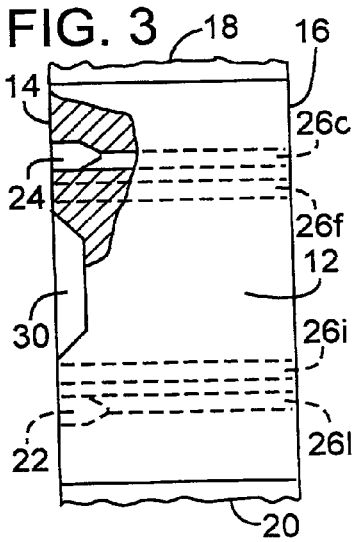

FIG. 4
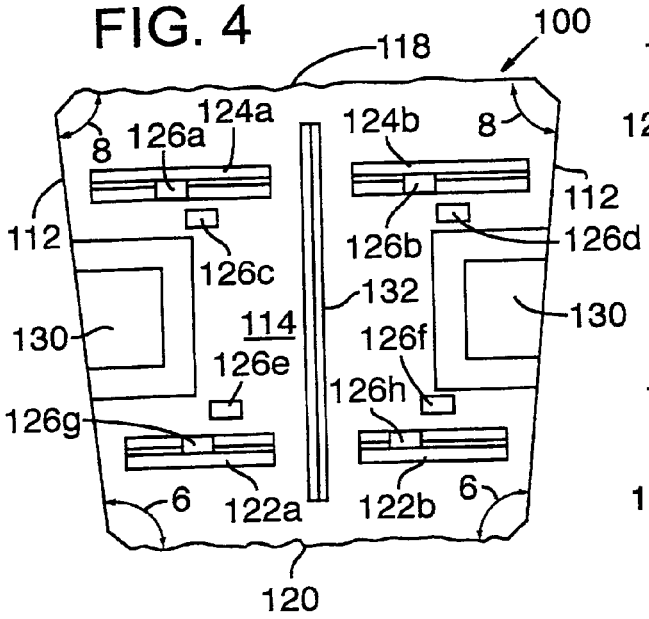
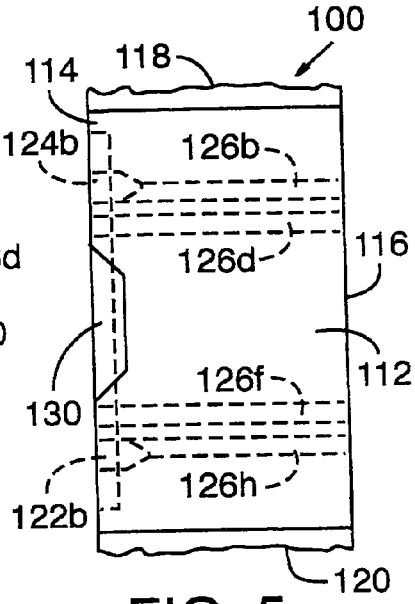
FIG. 5
FIG. 6
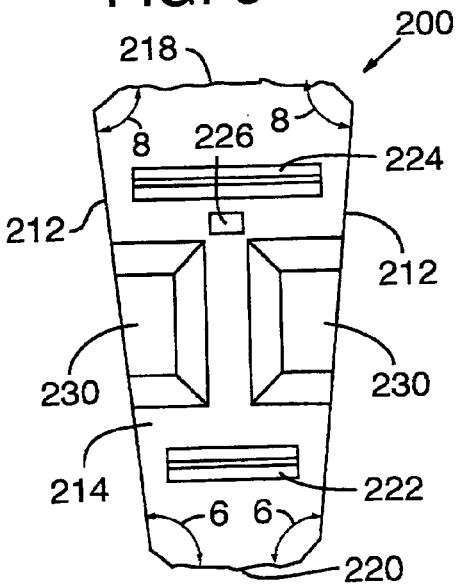
FIG. 7
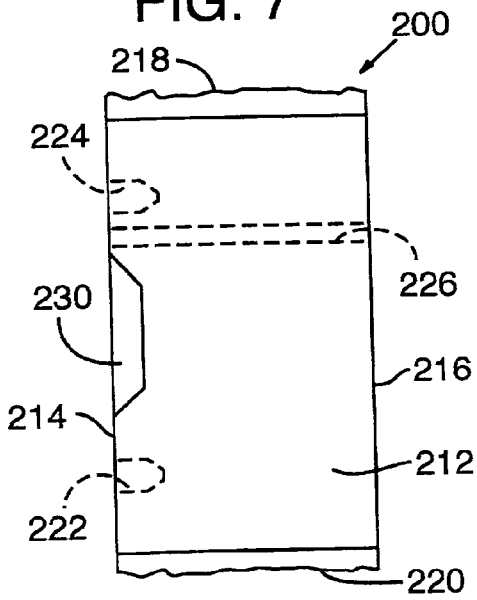

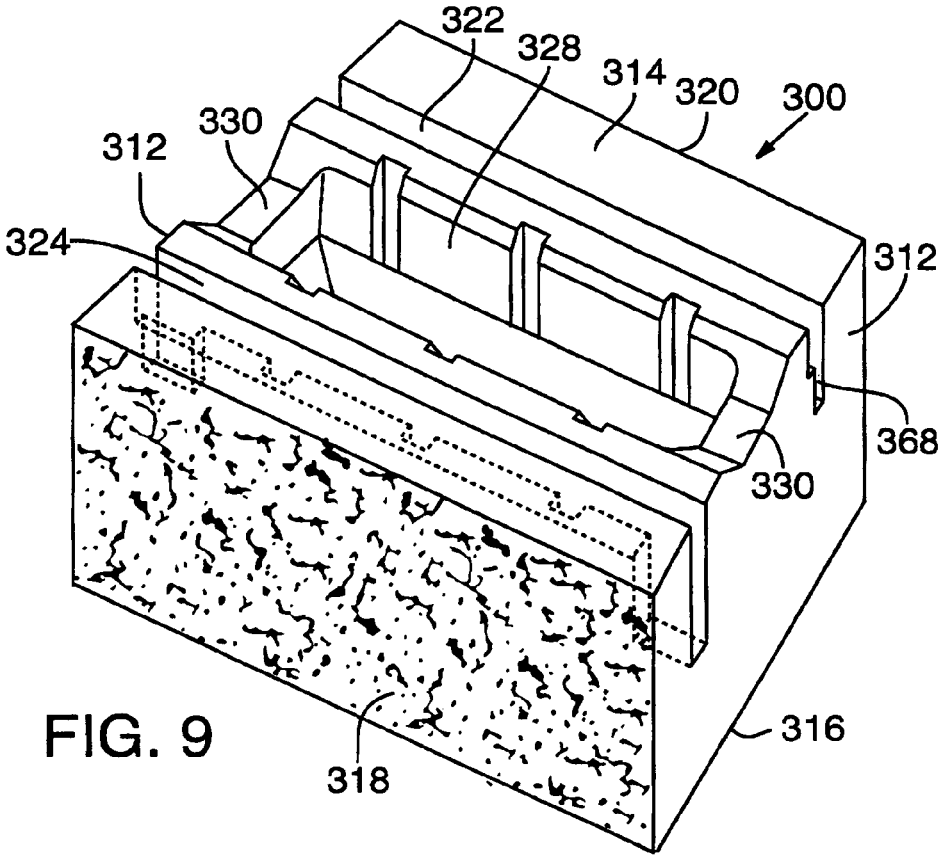
FIG. 9
FIG. 10
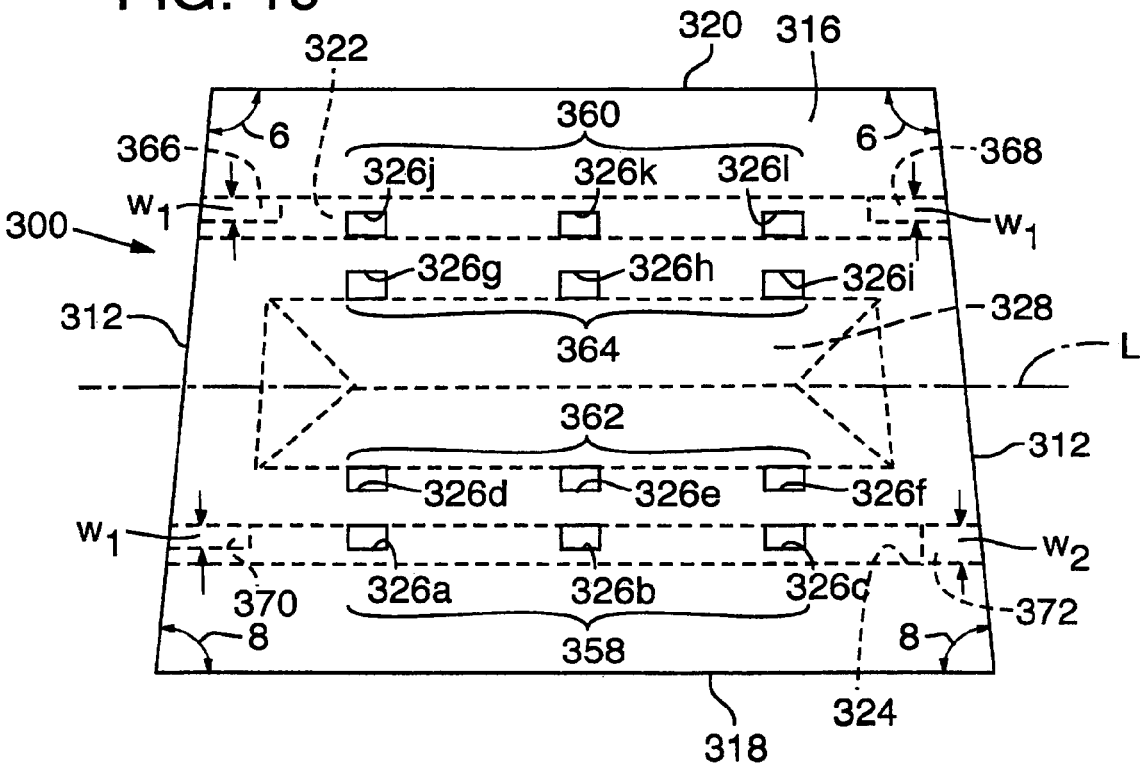

WALL BLOCK, SYSTEM AND MOLD FOR MAKING THE SAME

CROSS-REFERENCE TO RELATED APPLICATIONS

This application is a continuation-in-part of U.S. application Ser. No. 10/273,631, filed Oct. 18, 2002, now U.S. Pat. No. 7,328,537, which claims priority to U.S. Provisional Application No. 60/344,549, filed Oct. 18, 2001. This application is also a continuation-in-part of U.S. application Ser. No. 10/091,039, filed Mar. 4, 2002, now U.S. Pat. No. 7,100,886.

FIELD

The present invention relates to blocks, such as concrete blocks, for constructing walls, and more particularly to blocks employing a pin and slot system for interconnecting blocks stacked on top of each other in a wall, and to a mold for making such blocks.

BACKGROUND

Natural stone blocks cut from quarries have been used for a number of years to assemble walls of various types, including ornamental walls for landscaping purposes. Natural blocks have unique sizes, differences in shape and differences in appearance. However, construction of walls using such blocks requires significant skill to match, align, and place blocks so that the wall is erected with substantially uniform courses. While such walls provide an attractive ornamental appearance, the cost of quarried stone and the labor to assemble the stone blocks are generally cost prohibitive for most applications.

An attractive, low cost alternative to natural stone blocks are molded concrete blocks. In fact, there are several, perhaps hundreds, of utility and design patents which relate to molded blocks and/or retaining walls made from such blocks. Most prior art walls, however, are constructed from dimensionally identical blocks which can only be positioned in one orientation within the wall. Thus, a wall made from such molded or cast blocks does not have the same random and natural appearance of a wall made from natural stone blocks.

Accordingly, there is a need for new and improved molded blocks, methods for forming blocks, and block systems and methods, for constructing walls that have a more natural appearance than walls constructed using molded blocks, block systems, and molded block methods of the prior art.

SUMMARY

According to one aspect, the present disclosure relates to embodiments of a wall block and block systems employing a pin and slot connection system for interconnecting blocks stacked on top of each other in a wall.

A wall block, according to one embodiment, includes an upper surface spaced apart from a substantially parallel lower surface, first and second, substantially parallel faces, and first and second, substantially straight side surfaces extending between respective ends of the first and second faces. The first face of the block has a surface area greater than the second face. The block is adapted to be "reversible" in a wall, that is, either the first face or the second face can serve as the exposed face in one side of the wall, thereby giving the appearance that the wall is constructed from two differently sized blocks. In certain embodiments, both faces have a roughened or split look resembling natural stone.

To interconnect vertically adjacent blocks (i.e., blocks stacked on top of each other in a wall), the upper surface of the block is formed with at least two pin holes and the lower surface is formed with at least one pin-receiving slot or channel. A first pin hole is spaced a first distance from a longitudinal axis extending between the side surfaces and bisecting the upper surface. A second pin hole is located on the same side of the longitudinal axis as the first pin hole, but is spaced a second distance, greater than the first distance, from the longitudinal axis. Also, the first pin hole is offset from the second pin hole in the direction of the longitudinal axis so as to minimize breakage of the concrete between the pin holes if the block is tumbled.

In particular embodiments, the lower surface of the block is formed with a first pin-receiving slot and a second pin-receiving slot extending parallel to the first pin-receiving slot. The pin-receiving slots are located on opposite sides of a longitudinal axis extending between the side surfaces and bisecting the lower surface. The upper surface of the block further includes third and fourth pin holes located on the opposite side of the longitudinal axis from the first and second pin holes. The fourth pin hole is spaced farther from the longitudinal axis than the third pin hole and is offset from the third pin hole in the direction of the longitudinal axis. The pin holes and the pin-receiving slots permits vertical, set forward, or set back placement of blocks in a course relative to blocks in an adjacent lower course.

According to another aspect, a block system can be provided that includes plural similarly shaped, but differently sized blocks. In one embodiment, for example, such a block system includes a small, medium, and large block. Each block has the same depth and height, but different lengths. Each block has converging side walls and is reversible so that each block can be used to provide at least two different sized faces in the surface of a wall. The angles of convergence of the side walls of each block are substantially the same so that placing blocks of any size side-by-side in a course, with every other block being reversed 180 degrees forms a substantially straight wall. Additionally, the opposing faces of each block can be provided with a roughened surface texture.

The small, medium, and large blocks can be formed in a mold that does not require splitting of the blocks or removing sacrificial portions from the blocks to achieve a roughened surface texture resembling natural stone on two opposing faces of each block. In an illustrated embodiment, the mold has first and second end walls, first and second side walls extending between respective ends of the end walls, and a first divider wall extending between the first and second side walls and separating the mold into a first mold portion and a second mold portion. The first mold portion comprises a first cavity for forming the large block. A second divider wall in the second mold portion extends between the first end wall and the first divider wall so as to define a second cavity for forming the medium block and a third cavity for forming the small block. The end walls and the first divider wall are configured to form roughened surface textures on two surfaces of each of the small, medium, and large block as the blocks are removed from the mold cavities in an uncured state.

In particular embodiments, the first end wall has inwardly extending projections for contacting adjacent block surfaces of the medium block in the second mold cavity and the small block in the third cavity. The second end wall has inwardly extending projections for contacting an adjacent block surface of the large block in the first cavity. One surface of the first divider wall has inwardly extending projections for contacting an adjacent block surface of the large block in the first cavity. Another surface of the first divider wall has inwardly extending projections for contacting adjacent block surfaces of the medium and small blocks in the second and third cavities. As the mold is moved vertically with respect to the uncured blocks for removing them from the mold cavities, the projections on the mold walls scour or abrade the adjacent block surfaces, thereby creating an irregularly roughened surface for those sides of the blocks.

The foregoing and other features and advantages of the invention will become more apparent from the following detailed description of several embodiments, which proceeds with reference to the accompanying figures.

BRIEF DESCRIPTION OF THE DRAWINGS

FIG. 1 is a bottom perspective view of a wall block, according to one embodiment.

FIG. 2 is a bottom plan view of the block of FIG. 1.

FIG. 3 is a side elevational view of the block of FIG. 1.

FIG. 4 is a bottom plan view of another embodiment of a wall block.

FIG. 5 is a side elevational view of the block of FIG. 4.

FIG. 6 is a bottom plan view of yet another embodiment of a wall block.

FIG. 7 is a side elevation view of the block of FIG. 6.

FIG. 9 is a bottom perspective view of another embodiment of a wall block.

FIG. 10 is a top plan view of the block of FIG. 9.

DETAILED DESCRIPTION

Figure 8:
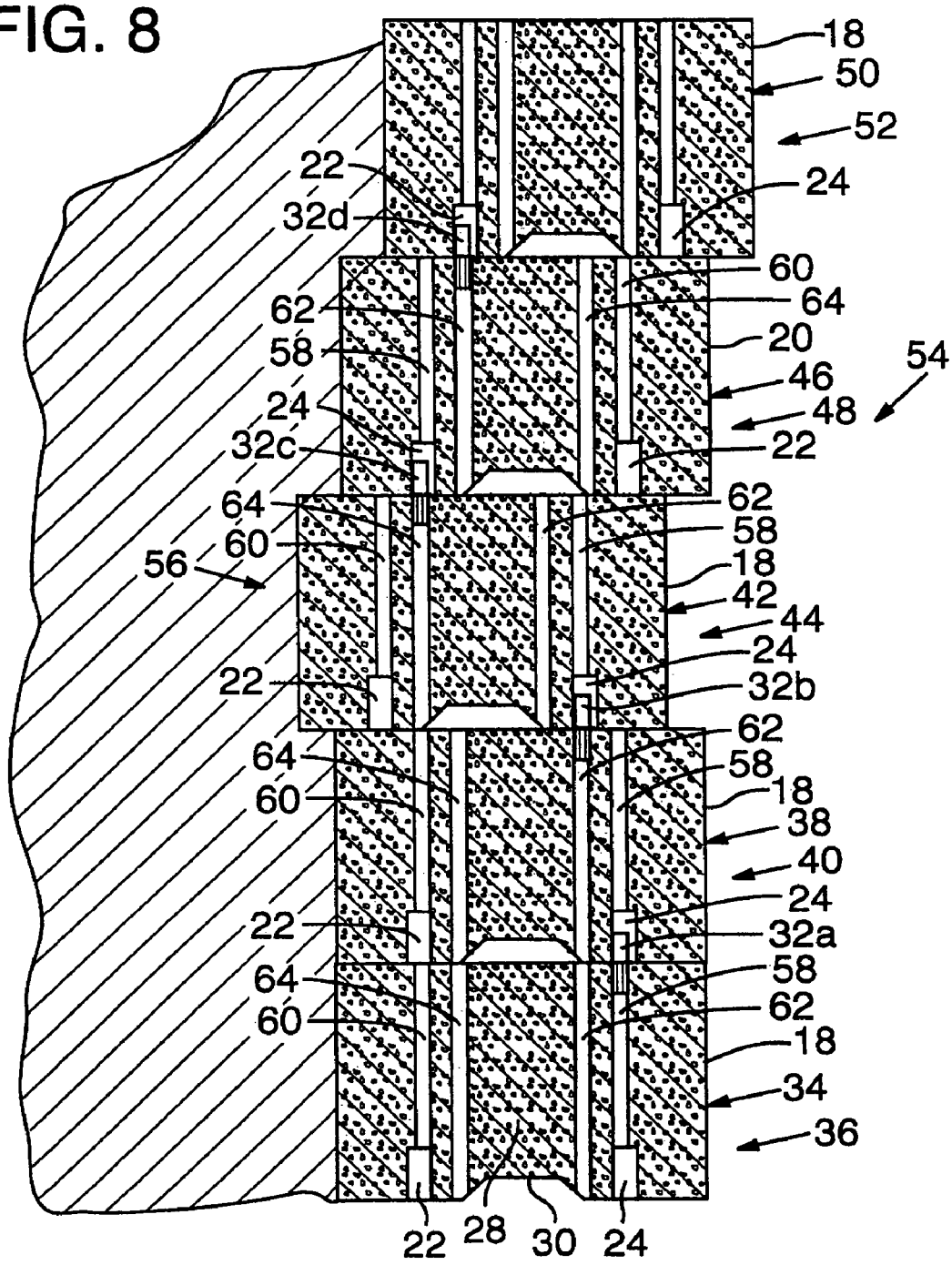
FIG. 8 is a vertical sectional view of a wall, from front to back, constructed from like blocks having the configuration of the blocks shown in FIGS. 1-3.

As used herein, the singular forms "a," "an," and "the" refer to one or more than one, unless the context clearly dictates otherwise. As used herein, the term "includes" means "comprises."

In the following description, "upper" and "lower" refer to the placement of a block in a retaining wall. The lower, or bottom, surface of a block is placed such that it faces the ground. In a retaining wall, one row of blocks is laid down, forming a lowermost course or tier. An upper course or tier is formed on top of this lower course by positioning the lower surface of one block on the upper surface of another block. Additional course may be added until a desired height of the wall is achieved. Typically, earth is retained behind a retaining wall so that only a front surface of the wall is exposed. A free-standing wall (i.e., one which does not serve to retain earth) having two exposed surfaces may be referred to as a "fence."

According to a first aspect, a block for constructing a wall is configured to be reversible, that is, the block has at least two surfaces of different dimensions, each of which can be used as the exposed face in a surface of a wall. According to another aspect, a pin and slot connection system for interconnecting blocks of adjacent courses permits alignment of blocks directly over one another, set forward, or set backward relative to one another so that either vertical or non-vertical walls may be constructed.

Referring first to FIGS. 1-3, there is shown a block 10 according to one representative embodiment. FIG. 1 is a bottom perspective view of the block 10, FIG. 2 is a bottom plan view of the block 10, and FIG. 3 is a side elevational view of the block 10. The illustrated block 10 is generally trapezoidal and comprises opposed side walls or side surfaces 12, generally parallel bottom and top surfaces 14, 16, respectively, and generally parallel first and second faces 18, 20, respectively. The side walls 12 taper inwardly, or converge, as they extend from the first face 18 to the second face 20 so that acute angles 8 are formed between the first face 18 and side walls 12 and obtuse angles 6 are formed between the second face 20 and side walls 12. Hence, the surface area of the first face 18 is greater than the surface area of the second face 20. Alternatively, the block can have one side wall that is generally perpendicular to the first and second faces. In other embodiments, the block can have other geometric shapes, such as a square or rectangle.

Desirably, the surface texture of the first face 18 is the same as that for the second face 20. In this manner, the block 10 is "reversible," that is, either the first face 18 or the second face 20 can serve as the exposed face on one side of a wall. Since the first face 18 is larger than the second face 20, a wall constructed from such blocks takes on a more random, natural appearance, than a wall in which the exposed faces of all blocks are equal in size. In the illustrated embodiment, for example, both the first face 18 and the second face 20 are provided with a roughened, or split look (known as a "split face" or "rock face") (as shown in FIG. 1) to contribute to the natural appearance of the wall. As used herein, a "roughened" block surface refers to a surface texture that can be formed by splitting two conjoined blocks or splitting a sacrificial portion from a block, or by creating such a surface texture on an uncured block as it is removed from a mold, such as described in detail below. The block also may be "tumbled" to round the edges and corners of the block, as generally known in the art. Alternatively, the block 10 may be molded so that one or both of faces 18, 20 have a smooth, rather than a rough, surface.

Pin-receiving slots (also referred to herein as troughs or channels) 22, 24 formed in the bottom surface 14 extend longitudinally of the block between the side walls 12, but terminate short of the side walls as shown. This minimizes breakage of the blocks if they are tumbled. The slots 22, 24 allow a block to be shifted longitudinally in a course either to the left or the right so that the block is longitudinally offset from a block in an adjacent lower course. Thus, a block in an upper course can be positioned to span two blocks in a lower course and be connected to them with a connected pin extending into one of the slots from one or both of the blocks in the lower course.

In other embodiments, a block can be provided with slots that extend completely across the length of the block between the side walls (such as slots 322, 324 of block 300 shown in FIGS. 9 and 10). This allows the block to be stacked on its side in a wall as a "vertical jumper," as further described below.

The block 10 may also have a centrally located core (not shown) between the channels 22, 24 to reduce the overall weight of the block 10. The core can be a semi-hollow or partial core that extends from the bottom surface partially through the block (e.g., core 328 of block 300 shown in FIGS. 9 and 10). Alternatively, the core may be a full core, that is, a core that extends completely through the block. When forming courses with blocks having full cores, the cores can be filled with a fill material, such as gravel, to prevent migration of earth into the core. In addition, the block 10 may have optional hand holds or handles 30 defined in the bottom surface 14 at each side wall 12 to facilitate carrying or placement of the block 10.

As best shown in FIG. 2, the block 10 has a plurality of pin-receiving apertures such as pin holes 26*a*-26*l* formed in the upper surface 16. The pin holes 26*a*-26*l* are shown as extending completely through the block, although this is not a requirement. In an alternative embodiment, the pin holes 26*a*-26*l* extend partially through the block from the upper surface 16. In any event, the pin holes 26*a*-26*l* are arranged in four rows extending substantially parallel to the first and second faces 18, 20. Each row in the illustrated embodiment has three such pin holes 26, although the number of pins holes 26 in each row, as well as the number of rows of pin holes 26, may vary.

The pin holes in the illustrated embodiment have a rectangular cross-sectional profile. Also, the pin holes desirably are elongated in the direction of the length of the block. This allows the position of a pin within a pin hole to be shifted longitudinally toward either side wall 12 so that the pin can be easily aligned with a channel of an overlying block.

In other embodiments, the pin holes can have other geometric shapes such as circles, ovals, squares, triangles, or various combinations thereof. It has been found that when forming blocks having circular pin holes, concrete tends to build up or collect in the pin holes. On the other hand, rectangular pin holes, such as shown in the illustrated embodiments, and square pin holes are advantageous in that they minimize or totally prevent the build up of concrete in the pin holes.

Pins holes 26*a*, 26*b* and 26*c* comprise an outer row 58 of pin holes which are vertically aligned with the channel 24. Pin holes 26*j*, 26*k* and 26*l* comprise an outer row 60 of pin holes which are vertically aligned with the channel 22. Desirably, pin holes 26*a*, 26*b*, 26*c* and 26*j*, 26*k*, 26*l* are positioned so as to have one side tangent to the inner wall of a respective channel 24, 22. This, as explained in greater detail below, prevents earth retained behind the wall, which exerts forward pressure on the wall, from upsetting the vertical alignment of the blocks in the wall. The outer rows 58, 60 of pin holes are equally spaced a predetermined first distance from a longitudinal axis, or plane, L, extending through the block halfway between the first and second faces 18, 20 (that is, plane L bisects the block between its faces 18, 20). Pin holes 26*d*, 26*e* and 26*f* comprise an inner row 62 of pin holes between the outer row 58 and the plane L. Pin holes 26*g*, 26*h* and 26*i* comprise an inner row 64 of pin holes between the outer row 60 and the plane L. The inner rows 62, 64 are equally spaced from the plane L a predetermined second distance that is less than the distance between each outer row 55, 60 and the plane L.

As further shown in FIG. 2, the pin holes 26*a*, 26*b*, and 26*c* of outer row 58 are longitudinally offset from the pins holes 26*d*, 26*e*, and 26*f*, respectively, of inner row 62. In a similar fashion, the pin holes 26*j*, 26*k*, and 26*l* of outer row 60 are longitudinally offset from the pin holes 26*g*, 26*h*, and 26*i*, respectively, of inner row 64. Advantageously, staggering the placement of pin holes in the manner shown in FIG. 2 minimizes breakage of the concrete separating pairs of adjacent pin holes (e.g., pin hole 26*a* and pin hole 26*d*) when the block is subjected to tumbling.

Figure 12:
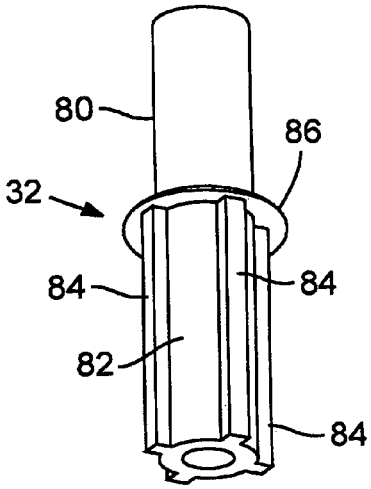
FIG. 12 is a perspective view of a connecting pin, according to one embodiment, that can be used to interconnect vertically adjacent blocks.

FIG. 12 illustrates a pin 32, according to one embodiment, that can be used to interconnect blocks in a wall. The illustrated pin 32 includes a generally cylindrical upper portion, or head, 80, and a generally cylindrical lower portion 82. The lower portion 82 can include a plurality of circumferentially spaced, elongate ribs 84 that extend longitudinally of the pin. The pin 32 also can be formed with radially extending, annular rib, or apron, 86 adjacent the upper ends of ribs 84.

Figure 13:
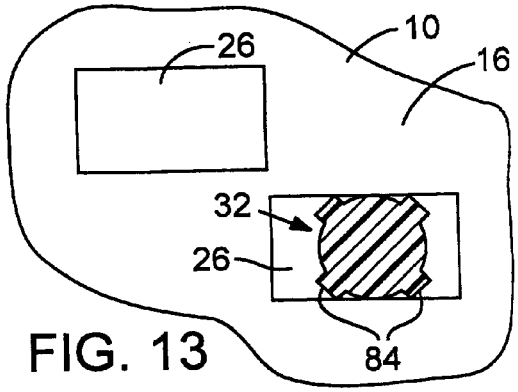
FIG. 13 is a partial, schematic plan view of the upper surface of a block showing a connecting pin inserted in a pin hole of the block.

When constructing a wall from a plurality of like blocks 10, the lower portion 82 of a pin 32 is inserted into any one of pin holes 26 in the upper surface of a block. The upper portion 80 of the pin is positioned in one of the slots 22, 24 of an overlying block. As depicted in FIG. 13, the ribs 84 function to frictionally engage the front and rear vertical surfaces of the pin hole 26. The apron 86 (not shown in FIG. 13) of the pin is sized to engage the upper surface 16 of the block and therefore assists in maintaining the vertical position of the pin relative to the pin hole. Since the pin hole is elongated, the pin 32 can be shifted longitudinally in the pin hole to the left or the right to assist in aligning the pin with a slot 22, 24 of an overlying block.

FIG. 8 illustrates a vertical cross-sectional, side elevational view of a wall made from a plurality of like blocks having the same general shape as block 10 shown in FIGS. 1-3. The wall has a front, exposed surface 54 and a rear surface 56, behind which earth may be retained. Of course, if the wall is a freestanding wall, then both the first and second surfaces 54, 56 are exposed. The first, lowermost course 36 of such a wall typically is laid in a trench (not shown) and successive courses 40, 44, 48 and 52 are laid one on top of the other. Either the first or second face 18, 20 of any one block may be used to form the front surface 54 of the wall. Pins 32 can be used to hold the courses of blocks in place, although in some applications, such as where a wall is relatively short in height, the weight of the blocks may be sufficient to hold the blocks in place without the use of pins.

When constructing engineered or structural walls (e.g., walls typically built above a height of about four feet), a suitable geogrid can be placed between courses of blocks to extend into the hillside or earth behind the wall to give the wall sufficient strength and stability. Blocks having full cores (i.e., a core extending completely through the block) are preferred (although not required) when using geogrid because the fill material placed in the cores assists in retaining the geogrid between adjacent courses.

As mentioned, the pin and slot connection system permits vertical, set forward, or set back placement of blocks in a course relative to the blocks in an adjacent lower course. As shown in FIG. 8, for example, a block 38 in the second course 40 is vertically aligned with a block 34 in the first, lowermost course 36. The lower portion of a pin 32*a* in this illustration is positioned in a pin hole 26 of the outer row 58 of block 34. The head of pin 32*a* is positioned in the slot 24 of block 38. As noted above, the pin holes of the outer rows 58, 60 of pin holes are positioned so as to have one side tangent to the inner wall of a channel 22, 24 (as best shown in FIG. 2). As depicted in FIG. 8, this allows the head of pin 32*a* to contact an inner surface of the slot 24. This contact between the head of the pin and the inner surface of the slot resists any forward movement of block 38 caused by the pressure of earth retained behind the wall so as to maintain the desired vertical alignment of block 38 with respect to block 34. To ensure that the wall is sufficiently stable, at least one pin is used to interconnect each block of one course with a block of an adjacent lower course (as shown in FIG. 8), although more than one pin may be used for redundancy or for interconnecting a lower block with two overlying blocks.

Block 42 of the third course 44 is in a set back relation to block 38 of the second course 40. In this position, slot 24 of block 42 is aligned over the inner row 62 of pin holes of block 38 with the lower portion of a pin 32*b* received in a pin hole 26 of block 38 and the head of pin 32*b* received in slot 24 of block 42. Block 46 of the fourth course 48 is in a set forward relation to block 42 of the third course 44 with slot 24 of block 46 being aligned over an inner row 64 of pin holes 26 of block 42. Block 46 is also reversed in the wall so that its second face 20 is exposed in the first surface 54 of the wall and its first face 18 forms part of the second surface 56 of the wall. A pin 32*c* is partially received in a pin hole 26 of block 42 and slot 24 of block 46 to hold these blocks together. Block 50 of the fifth course 52 is in a set forward position with respect to block 46 of the fourth course 48, with slot 22 of block 50 being aligned over an inner row 62 of pin holes 26 of block 46. A pin 32*d* is partially received in a pin hole 26 in the upper surface 16 of block 46 and slot 22 of block 50.

FIGS. 9 and 10 illustrate a block 300, according to another embodiment, having first and second faces 318 and 320, respectively, bottom and top surfaces 314 and 316, respectively, and side surfaces 312 extending between respective ends of the first and second faces 318, 320. The block 300 includes a first outer row 358 of pin holes 326*a*, 326*b*, and 326*c*, a second outer row 360 of pin holes 326*j*, 326*k*, and 326*l*, a first inner row 362 of pin holes 326*d*, 326*e*, and 326*f*, and a second inner row 364 of pin holes 326*g*, 326*h*, and 326*i*. In this embodiment, the pin holes are aligned in rows extending from a first face 318 to a second face 320. Thus, pin holes 326*a*, 326*d*, 326*g*, and 326*j* are aligned in a first row; pin holes 326*b*, 326*e*, 326*h*, and 326*k* are aligned in a second row; and pin holes 326*c*, 326*f*, 326*i*, and 326*l* are aligned in a third row.

The block 300 is formed with channels 322 and 324 that extend longitudinally of the block and intersect the side walls 312 as shown. The block 300 also is formed with a centrally located core 328 that extends from the bottom surface 314 partially through the block, and hand holds 330 defined in the bottom surface 314 at each side wall to facilitate carrying or placement of the block.

The block 300 may be configured to be placed in a vertical orientation in a wall, as a "jumper" block. When used in this way, the side walls 312 serve as the top and bottom of the block in a wall and the bottom surface 314 and the top surface 316 serve as the side walls of the block in a wall. The length of the first face 318 therefore is the effective height of the block when used as a jumper.

Because the side walls 312 are angled with respect to the first and second surfaces 318, 320, the block 300, when used as a jumper, would be tilted slightly from a vertical plane of the wall. Also, a block placed on top of the upwardly facing side wall 312 of the jumper would be supported at an angle. Thus, to support the jumper and any overlying block in a vertically upright position, pin-receiving slots 366 and 368 are formed in the side walls 312 proximate the ends of channel 322. The widths $w_1$ of pin-receiving slots 366 and 368 are desirably, although not necessarily, dimensioned to form a frictional fit with the lower portion 82 of a connecting pin 32. When the block is turned on its side for vertical placement in a wall, pins are inserted into slots 366 and 368, which then support the block and any overlying block in a vertically upright position. Pin-receiving slots 370 and 372 are similarly formed in the side walls 312 proximate the ends of channel 324. Slot 370 serves as a pin hole for frictionally engaging the lower portion of a pin. Slot 372 has a width equal to that of channel 24 and serves as an extension of channel 324 to receive the upper portion of a pin.

Where a block is configured to be used as a jumper (such as block 300), the length of the first face 318 desirably is a multiple of the height of the block. For example, if the length of the first face 318 is twice the height of the block, then a jumper will span two horizontally oriented blocks, or courses, in the vertical direction. Thus, as explained below with respect to FIG. 11, it is still possible to achieve a level upper surface of the wall.

Figure 11:
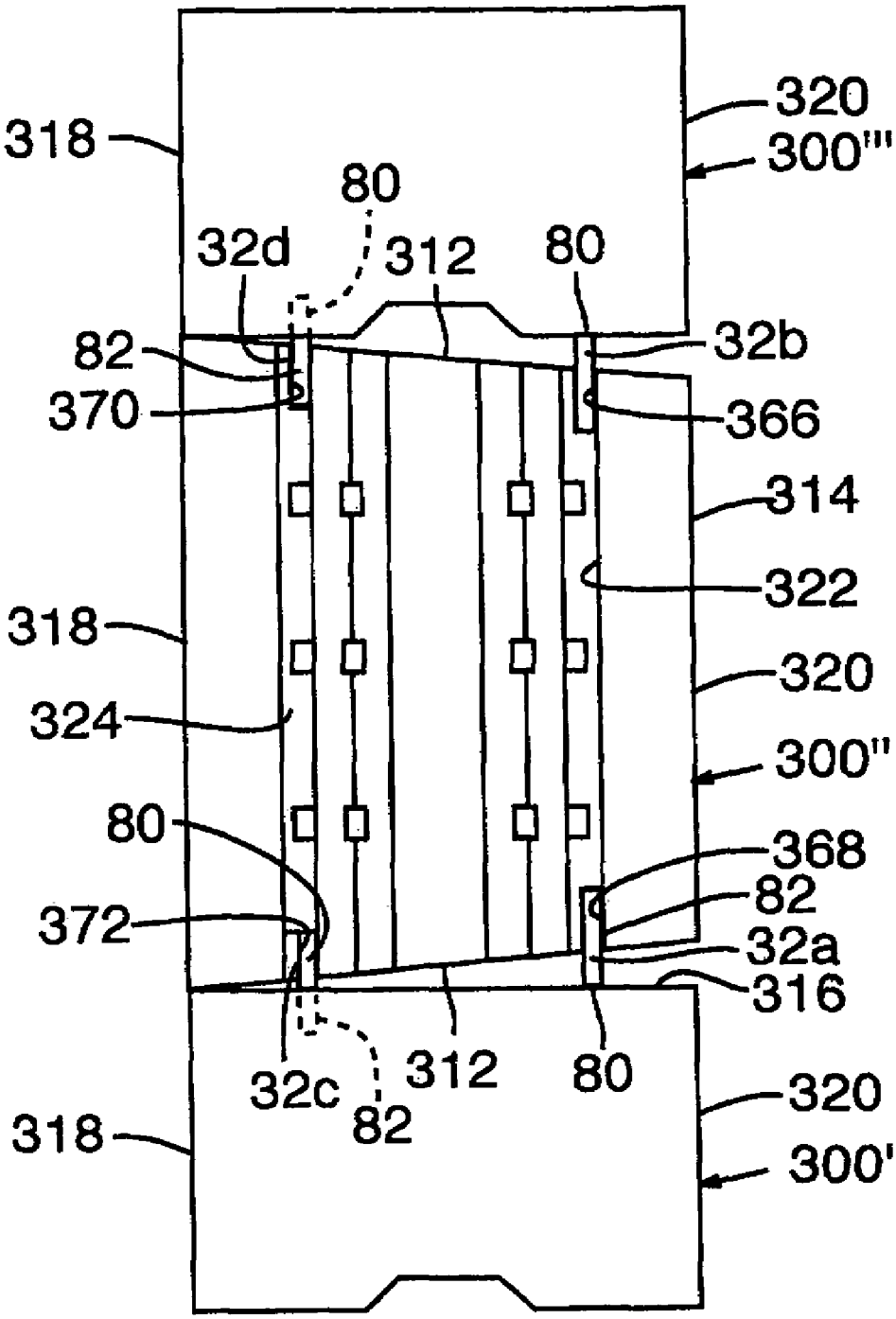
FIG. 11 is a vertical sectional view of a wall constructed from like blocks having the configuration of the blocks of FIGS. 9 and 10, wherein one such block is positioned in a vertical orientation as a jumper.

FIG. 11 illustrates the use of block 300 as a jumper. A wall in this illustration includes a first block 300' in a first course, a second block 300" in a second course and a third block 300'" in a third course. Blocks 300', 300" and 300'" are of the same general shape as block 300 of FIGS. 9 and 10. The second block 300" is turned on its side so that one of its side walls 312 is adjacent the upper surface 316 of the first block 300' and the other is adjacent the lower surface 314 of the third block 300'".

As shown in FIG. 11, the lower portion 82 of a pin 32*a* is inserted into slot 368 of the second block 300" and the head 80 of the pin 32*a* contacts the upper surface 316 of the first block 300' to support the downwardly facing side wall 312 of block 300" (i.e., the side wall 312 serving as the bottom of block 300") at a position above the upper surface 316 of block 300'. The head 80 of the pin 32*a* is long enough to support the second block 300" in a vertically upright position.

A pin 32*b* inserted into slot 366 of block 300" supports block 300'" in a level, vertically upright position. Since pin 32*b* is aligned with channel 322 of block 300'", the head 80 of pin 32*b* should have a thickness or diameter greater than the width of channel 322 to prevent insertion of the pin therein. Alternatively, if pin 32*b* is a standard sized pin (i.e., a pin having a diameter that is less than the width of channel 322) a small section of pipe, having a diameter larger than the width of the channel 322, can be placed over the head 80 of pin 32*b* to prevent insertion of pin 32*b* into channel 322 of block 300'''. In an alternative embodiment, slot 366 is offset slightly from channel 322 towards the first face 20 or second face 18 so that a pin inserted into slot 366 is not vertically aligned with a channel in an overlying block.

The lower portion 82 of a pin 32*c* is received in a pin hole in the upper surface of block 300' and the head 80 of pin 32*c* is received in slot 372 of jumper block 300'' to connect blocks 300' and 300''. The lower portion 82 of a pin 32*d* is received in slot 370 of block 300'' and the head 80 of pin 32*d* is received in a respective channel 324 in block 300''' to connect blocks 300'' and 300'''.

As shown, a course may comprise blocks of different effective "heights," thereby further contributing to the random appearance of the wall. In this illustration, the effective height of the jumper block 300'' (i.e., the length of the first face 318) is equal to the overall height of two horizontally oriented blocks stacked on top of each other. Because the height of the jumper block 300'' is a multiple of the height of the other blocks in the wall, it is possible to achieve a level upper surface of the wall.

A block system can be provided that includes plural similarly shaped, but differently sized blocks. In one embodiment, for example, such a block system includes a large block comprising the block 10 shown in FIGS. 1-3, a medium block comprising the block 100 shown in FIGS. 4 and 5, and a small block comprising the block 200 shown in FIGS. 6 and 7. Each block is of the same general shape. The medium block 200 (FIGS. 4 and 5), like the large block 10, has a first face 118, a second face 120 and converging side walls 112. Similarly, the small block 200 (FIGS. 6 and 7) has a first face 218, a second face 220 and converging side walls 212.

The surface area of the first face of each block is larger than the surface area of its second face. Desirably, although not necessarily, each block is the same in depth (i.e., the distance from the first face to the second face of a block, for example, between the first face 18 and the second face 20 of the large block 10) and in height (i.e., the distance from the upper surface to the lower surface of a block). The length of the first face 18 of the large block 10 (i.e., the distance the first face 18 extends between side walls 12) desirably is equal to or a multiple of the height of the blocks so that it is possible to achieve a level top surface of a wall if the large block is adapted to be used as a jumper.

As shown in FIG. 4, the medium block 100 is formed with a first row of pin holes 126*a* and 126*b*; a second row of pin holes 126*c* and 126*d*; a third row of pin holes 126*e* and 126*f*; and a fourth row of pin holes 126*g* and 126*h*. As shown, the pin holes of each row can be positioned in a staggered or offset relationship with respect to the pin holes of an adjacent row. The medium block 100 in the illustrated embodiment also is formed with hand holds 130, slots 122*a* and 122*b* adjacent the second face 120, and slots 124*a* and 124*b* adjacent the first face 118.

A splitting notch 132 extending in the direction of the block depth can be formed in the bottom surface 114. The notch 132 in the illustrated block is positioned equidistant from the side walls 112 and can be used to split the block into two smaller blocks of equal size, each having a side wall that is perpendicular to its first and second faces. One or both of the resulting smaller blocks can be used as a corner block for forming 90 degree corners in a wall, as described in greater detail below. In an alternative embodiment, the notch can be positioned closer to one of the side walls 112 so that the block can be split into two blocks of unequal size. In another embodiment, a splitting notch is not provided, in which case the block can be formed with two continuous pin-receiving slots, in the same manner as the large block 10, instead of four slots. Further, a splitting notch can be provided in one or both of the small and large blocks.

As shown in FIG. 6, the small block 200 in the illustrated embodiment is formed with hand holds 230, slots 222 and 224, and a pin hole 226. In other embodiments, however, the small block can be provided with any number of pin holes arranged in one or more rows.

The block system can be used to construct various straight or curvilinear walls of various radii. The angles of convergence of the side walls of each block in the three-block system desirably are substantially the same. Thus, placing blocks of any size side-by-side in a course, with every other block being reversed 180°, forms a substantially straight wall.

Figure 16:
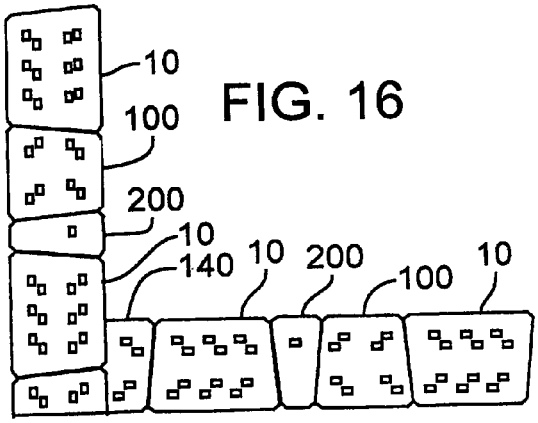
FIG. 16 is a top plan view of a wall constructed from the blocks shown in FIGS. 1-7 and having two straight wall portions intersecting at a 90 degree corner.

FIG. 16, for example, illustrates a top plan view of one example of a wall having two straight runs intersecting at a 90 degree angle. Each course is formed by placing small, medium and large blocks side-by-side with every other block being reversed so that the tapered side walls of each block is complemented by a side wall of an adjacent block to form a substantially straight wall. As shown, because the angle of convergence of the side walls of each block is the same, a closed joint is formed between the contacting side walls of adjacent blocks so that there are no spaces between adjacent blocks at the front and back surfaces of the wall. This allows the block system to be used for constructing a free-standing wall, or fence, where both sides of the wall are exposed. Blocks 140, which can be formed by splitting a medium block 100, are used to form a 90 degree corner at the intersection of the two sections of the wall.

Because the first face of each block is greater in surface area than the second face, each block can be used to provide at least two differently sized faces in the surface of a wall. Thus, a wall constructed from the small, medium, and large blocks has the appearance of a wall constructed from six differently sized blocks. The small, medium, and large blocks can be randomly positioned in each course, or alternatively, they can be used to create various patterns in the exposed surface of a wall. FIGS. 14A-14D, for example, illustrate four different patterns that can be created in a wall using the small, medium, and large blocks. Although not apparent in FIGS. 14A-14D, the walls may include blocks that are vertically aligned over one another, set forward or set back. See, for example, FIG. 8.

Figure 15:
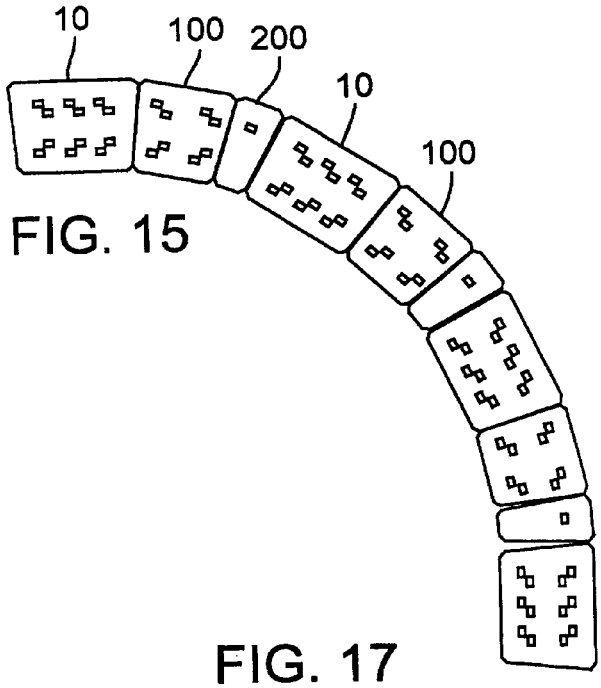
FIG. 15 is a top plan view of a curvilinear wall constructed from the blocks shown in FIGS. 1-7.

FIG. 15 shows a curved wall formed by repeating sequences of a large block 10, a medium block 100, and a small block 200. Other block combinations can be used to form curved walls of different radii. For example, curved walls can be constructed using all small blocks 200, all medium blocks 100, or all large blocks 10. Also, curved walls can be formed by alternating small blocks and large blocks, by alternating medium blocks and large blocks, or by alternating small blocks and medium blocks.

The dimensions of the small, medium and large blocks may vary. In one specific and exemplary embodiment of a three-block system, the first face 18 of the large block 10 is about 16 inches in length and the second face 20 is about 14 inches in length. The first and second faces 118, 120 respectively, of the medium block 100 are about 12 and 10 inches, respectively, in length. The first and second faces 218, 220, respectively, of the small block 200 are about 6 and 4 inches, respectively, in length. The height of each block is about 6 inches. Generally, increasing the depth of a block increases wall stability and hence, the overall allowable height of the wall. Also, if geogrid is used, increasing block depth increases the connection strength between a sheet of geogrid and the two courses that are stacked directly above and below the geogrid sheet. The depth of each block desirably is at least about 10.25 inches, which typically allows construction of 3 foot high walls without the use of geogrid. In other embodiments, the depth of each block is at least about 11.5 inches for constructing walls up to at least 4 feet in height without the use of geogrid. In still other embodiments, the depth of each wall is at least 12 inches for even greater wall stability and geogrid connection strength. The foregoing dimensions have been found to permit ease of handling and withstand the impact forces of the tumbling process. Additionally, a small, medium, and large block having the foregoing dimensions can be formed together in a mold that can be used with a standard size block-making machine.

Of course, those skilled in the art will realize, these specific dimensions (as well as other dimensions provided in the present specification) are given to illustrate the invention and not to limit it. These dimensions can be modified as needed in different applications or situations.

In alterative embodiments, one or more of the small, medium, and large blocks can be adapted to be used as a vertical jumper. In one system, for example, the large block can comprise the block 300 shown in FIGS. 9 and 10, which can be used as a vertical jumper as described above. However, in other systems, it is contemplated that either the small block or the medium block, or both, are configured to be used as a vertical jumper.

Figure 17:
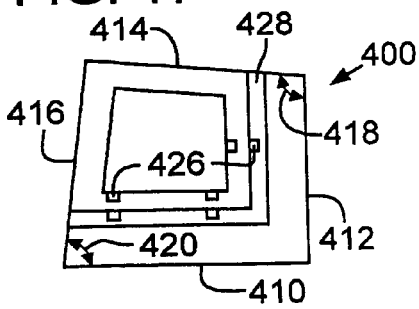
FIG. 17 is a top plan view of a corner block, according to one embodiment, that can be used for forming 90 degree corners in walls.
Figure 14A:
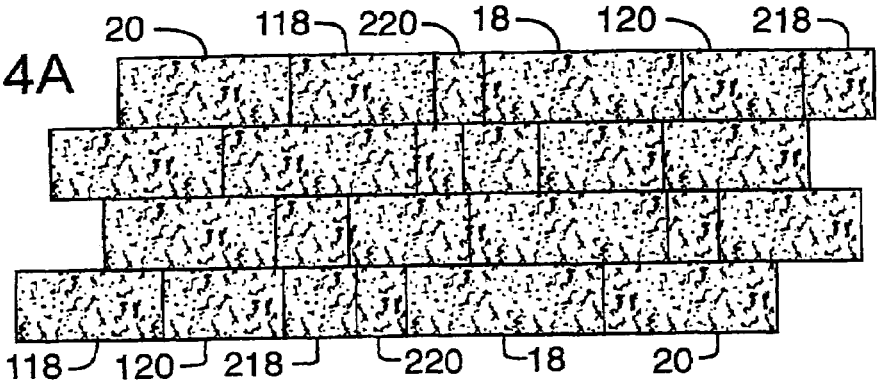
FIGS. 14A-14D are front elevational views of walls constructed from different combinations of the blocks shown in FIGS. 1-7.
Figure 14B:
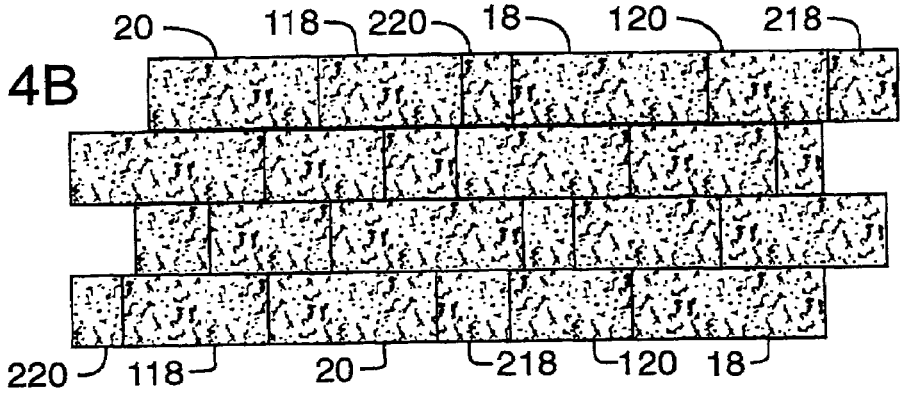
Figure 14C:
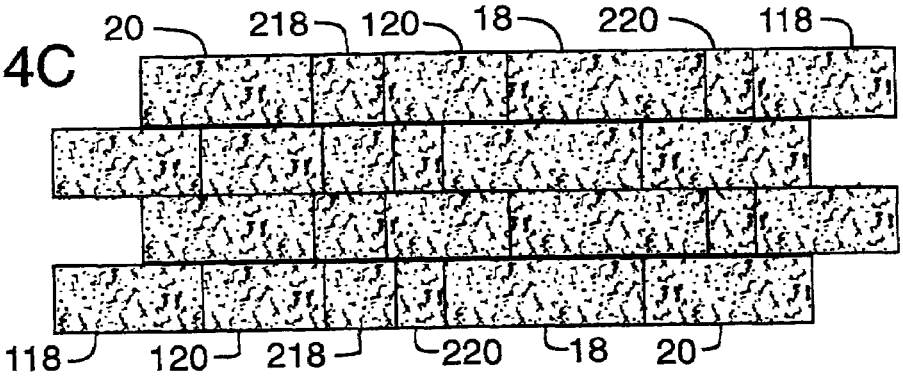
Figure 14D:
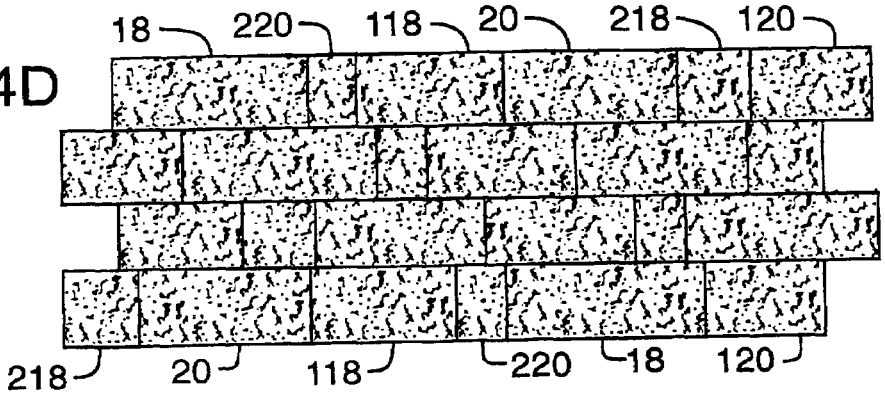

FIG. 17 illustrates one example of a corner block 400 that can be used in lieu of splitting a medium block 100 to form a 90 degree corner in a wall. The illustrated corner block 400 includes a first face 410 and a second face 412, which extend perpendicularly to each other to form a 90 degree corner. The first and second faces 410, 412, respectively, typically are exposed faces, and as such, they may be provided with a roughened, or split, surface, to contribute to the natural appearance of the wall. A third face 414 is oriented at an obtuse angle 418 relative to the second face 412. A fourth face 416 is oriented at an acute angle 420 relative to the first face 410. Angles 418 and 420 of the corner block 400 are equal to the included angles 6 and 8, respectively, of the small, medium and large blocks to complement the tapered side wall of an adjacent block in a course. The corner block 400 also can include pin holes 426 in the upper surface and a generally L-shaped channel 428 in the lower surface.

A block system according to another embodiment comprises a first set of blocks comprising a small, medium, and large block and a second set of blocks comprising a small, medium, and large block. The small block of each set has the same configuration as the block 200 shown in FIGS. 6 and 7; the medium block of each set has the same configuration as the block 100 shown in FIGS. 4 and 5; and the large block has the same configuration as the block 10 shown in FIGS. 1-3. The dimensions of the small block, medium block, and large block of the first set are equal to the dimensions of the small block, medium block, and large block, respectively, of the second set, except that the blocks of the second set are greater in height than the blocks of the first set. Desirably, the height of the blocks of the second set is a multiple of the height of the blocks of the first set to permit the construction of a wall having a level or planar top surface. Within each set, the blocks have the same depth (i.e., the distance between the first face and the second face of a block) and height (i.e., the distance between the upper and lower surface of a block). Since each block can be used to provide at least two differently sized faces in the surface of a wall, a wall constructed from the small, medium and large blocks of both sets has the appearance of a wall constructed from twelve differently sized blocks.

Figure 18:
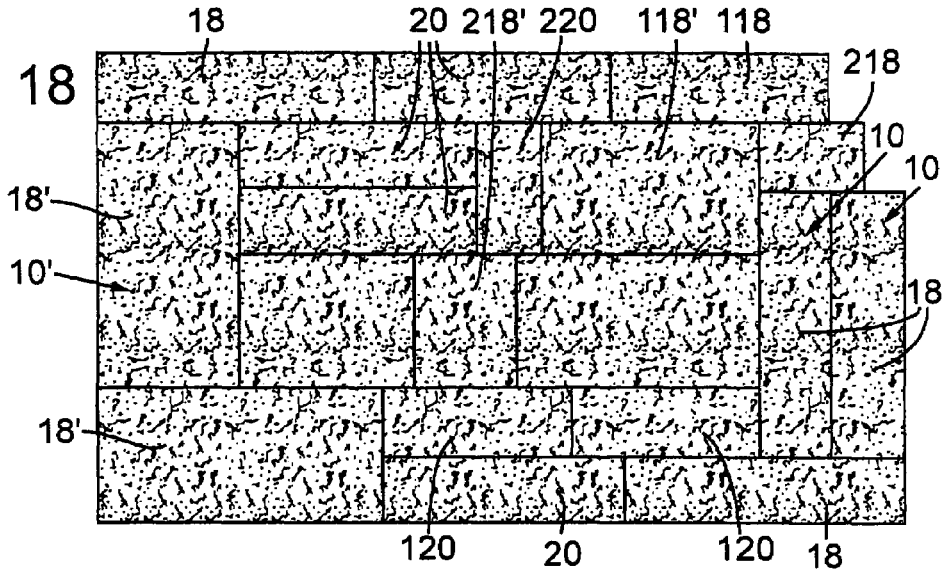
FIG. 18 is a front elevational view of a wall constructed from various blocks of a block system comprising a first set of small, medium, and large blocks and a second set of small, medium, and large blocks, wherein the blocks of second set have a height that is greater than the height of the blocks of the first set.

FIG. 18 illustrates one example of a portion of a wall constructed from small, medium and large blocks 10, 100, 200, respectively, of a first set of blocks and small, medium, and large blocks 10', 100', and 200' of a second set of blocks. In this illustration, the height of the blocks of the second set is twice the height of the blocks of the first set. Thus, as shown in FIG. 18, the courses of a wall may comprise blocks of different heights so as to contribute to the random, natural appearance of the wall and a level upper surface of the wall can be achieved by selective stacking of the blocks. This also can be accomplished with any two sets of blocks in which the height of the blocks of one set is a multiple of the height of the blocks of another set. For example, the height of the blocks of the first set can be three times the height of the blocks of the second set.

In addition, any of the blocks of the first and second sets can be configured for use as a jumper block. FIG. 18, for example, shows two larges block 10 of the first set and a large block 10' of the second set used as a jumper. The length of the first faces 18 and 18' of large blocks 10 and 10', respectively, desirably is equal to the overall height of several horizontally oriented blocks stacked on top of each other. In this illustration, for example, the length of the first faces of the large blocks is equal to the height of two horizontally stacked blocks of the second set or four horizontally stacked blocks of the first set.

In a specific and exemplary implementation of the present embodiment, a first set of blocks comprises a small, medium and large block having a height of about 8 inches, and a second set of blocks comprises a small, medium and large block having a height of about 4 inches. The first and second faces of the large block in each set are about 16 and 14 inches, respectively, in length. The first and second faces of the medium block in each set are about 12 and 10 inches, respectively, in length. The first and second faces of the small block in each set are about 6 and 4 inches, respectively, in length. The depth of each block of the first and second sets is about 11.5 inches.

Figure 19:
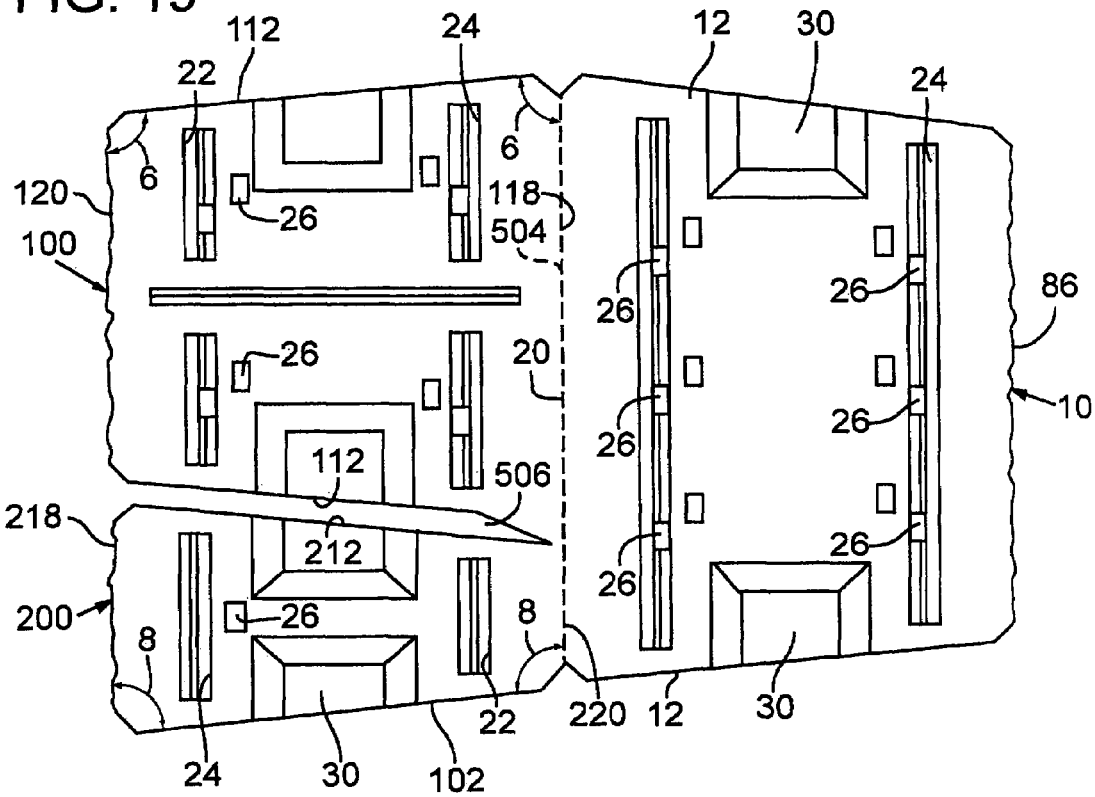
FIG. 19 is a top plan view of a three-block module that comprises a small, medium, and large block.

Blocks 10, 100, and 200 may be formed in a single mold as a three-block module, such as shown in FIG. 19. A substantially v-shaped notch 504 defines a groove or split line for separating the large block 10 from the small and medium blocks, 100, 200, respectively. These blocks may be split along notch 504 in any conventional manner, such as with a conventional hammer and chisel or a block-splitting machine, as known in the art. Sacrificial portions (not shown) may be molded to faces 20, 120 and 218, which are removed to provide the split look on those faces, as known in the art. During the casting process, a divider plate can be positioned between small block 200 and medium block 100 at 506 to provide a smooth surface on the abutting side wall 212 of block 200 and abutting side wall 112 of block 100.

Figure 20:
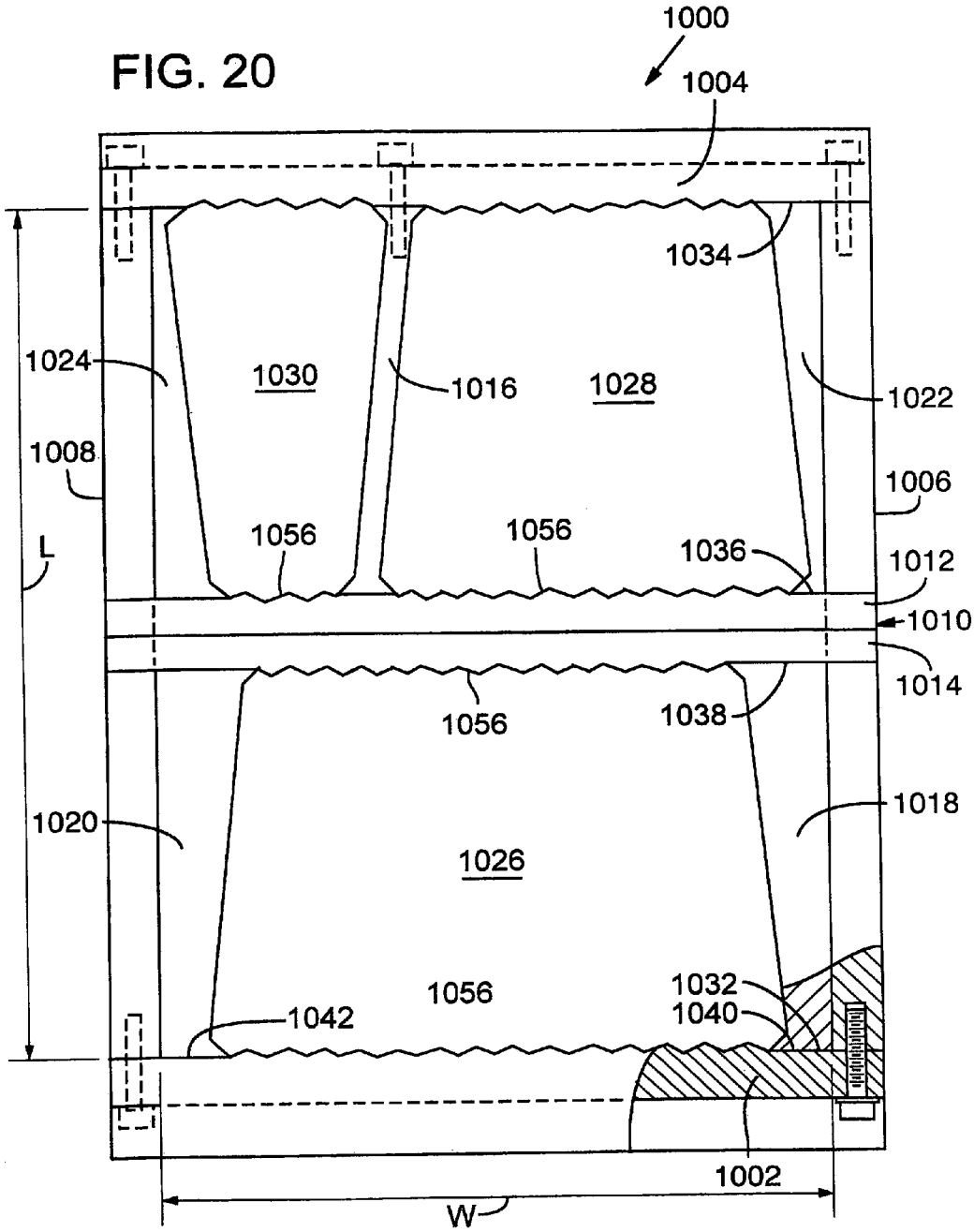
FIG. 20 is a top plan view of mold that can be used to form a small, medium, and large block, according to one embodiment.

In another embodiment, blocks 10, 100, and 200 can be formed in a mold that does not require splitting of the blocks or removing sacrificial portions from the blocks to achieve a "roughened" surface texture resembling natural stone or a split look on two opposing surfaces of each block. FIG. 20 shows one embodiment of such a mold, indicated generally at 1000, that can be used to form blocks 10, 100, and 200, with each block having their respective first and second faces roughened to resemble natural stone.

As shown in FIG. 20, the illustrated mold 1000 includes first and second end walls 1002 and 1004, respectively, and first and second side walls 1006 and 1008, respectively, extending between respective ends of the end walls. A divider wall 1010 extends between the side walls 1006 and 1008 so as to divide or partition the mold 1000 into two mold portions. Although not a requirement, the divider wall 1010 in the illustrated embodiment is positioned midway between the end walls 1006, 1008, and therefore bisects the mold into two equal mold portions. The divider wall 1010 can comprise first and second plates 1012 and 1014, respectively, placed in back-to-back relationship as shown, although in other embodiments the divider wall can have a unitary or one-piece construction.

A first mold portion is defined by the second plate 1014, the first end wall 1002, and the respective portions of side walls 1006, 1008 extending therebetween, and a second mold portion is defined by the first plate 1012, the second end wall 1004, and the respective portions of side walls 1006, 1008 extending therebetween. The first mold portion comprises a first mold cavity 1026 for forming the large block 10. A divider wall 1016 extends between the first plate 1012 and the second end wall 1004 so as to define a second mold cavity 1028 for forming the medium block 100 and a third mold cavity 1030 for forming the small block 200. The divider wall 1016 extends at an angle with respect to the plate 1012 and the end wall 1004 that is equal to angles 6 and 8 of the blocks (FIGS. 2, 4, and 6).

Mold inserts 1018 and 1020 can be positioned in the first mold cavity 1026 to form the converging side walls 12 of the large block 10. Similarly, mold inserts 1022 and 1024 can be positioned in the second and third mold cavities 1028, 1030, respectively to form respective side walls of the medium and small blocks. The mold 1000 has an open top through which block-forming material (e.g., concrete) may be introduced into the first, second, and third mold cavities, and an open bottom through which formed small, medium, and large blocks in an uncured state may be removed, or stripped, from the mold.

As shown, the mold in the illustrated embodiment is configured such that the end wall 1002 forms the first, or larger, face 18 of the large block 10, and the end wall 1004 forms the second, or smaller, face 120 of the medium block 100 and the second, or larger, face 218 of the small block 200. However, the mold also can be configured to mold the blocks in positions that are reversed from that shown in FIG. 20 such that the second face 20 of the large block is formed by the end wall 1002, and the first face 118 of the medium block and the second face 220 of the small block are formed by the end wall 1004.

Figure 23:
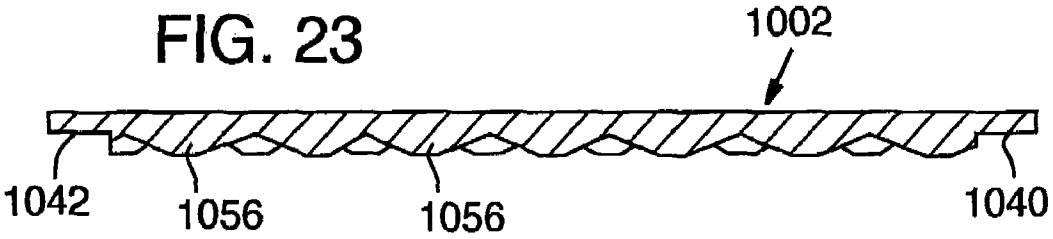
FIG. 23 is a cross-sectional view of the end wall of FIG. 21 taken along line 23-23 of FIG. 21.
Figure 21:
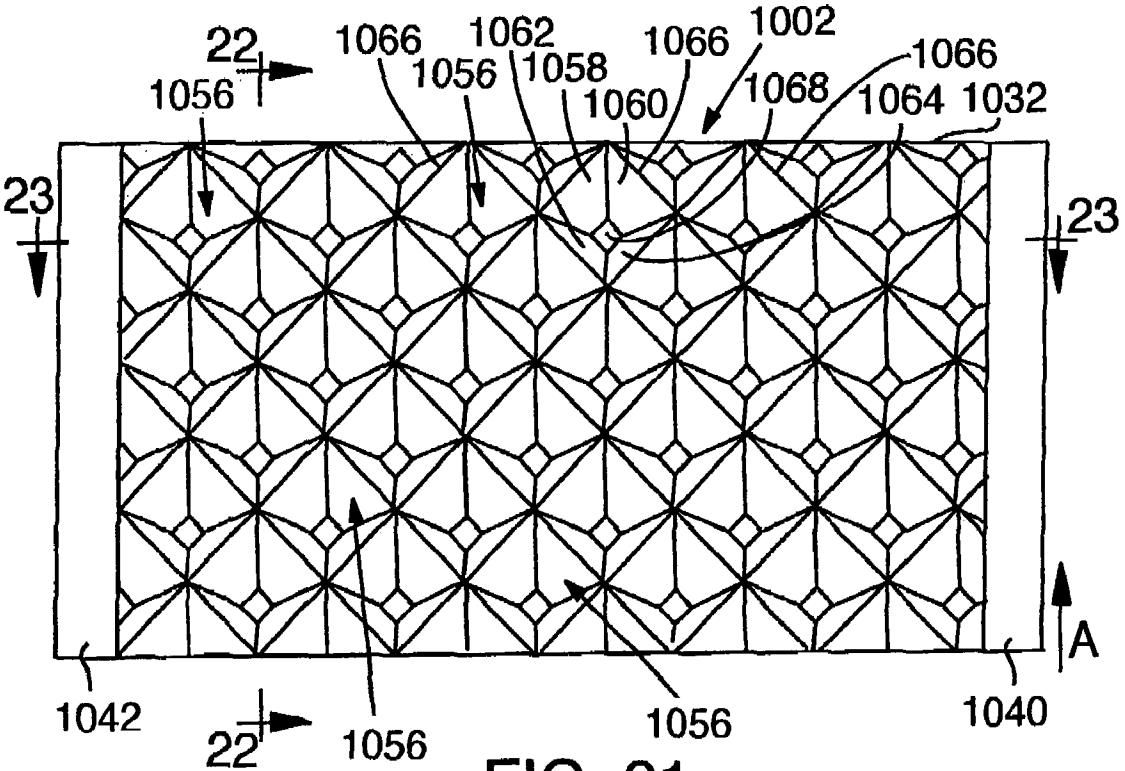
FIG. 21 is a front elevational view of one of the end walls of the mold shown in FIG. 20.
Figure 22:
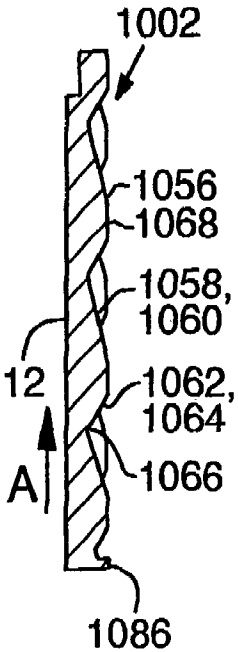
FIG. 22 is a cross-sectional view of the end wall of FIG. 21 taken along line 22-22 of FIG. 21.

In the illustrated embodiment, the interior surfaces 1032 and 1034 of the end walls 1002, 1004 and the surfaces 1036 and 1038 of the plates 1012, 1014 are configured to texture adjacent surfaces of the small, medium and large blocks as they are removed from their respective mold cavities, as described in greater detail below. FIGS. 21-23 illustrate in greater detail the end wall 1002 of the mold 1000 shown in FIG. 20. The end wall 1004 and the plates 1012, 1014 have a construction that is similar to that of the end wall 1002. Thus, the following description, which proceeds in reference to the end wall 1002, is also applicable to the end wall 1004 and the plates 1012, 1014.

As best shown in FIG. 21, the interior surface 1032 of the end wall 1002 is formed with a plurality of abutting block-texturing members, or projections, 1056 that extend into the first mold cavity 1026 and contact an adjacent surface of an uncured, large block. The interior surfaces 1034, 1036, 1038 also are formed with projections 1056 that contact adjacent block surfaces of uncured blocks in the mold cavities. As the mold 1000 is moved vertically with respect to the small, medium, and large blocks for removing them from their respective mold cavities, as indicated by arrow A in FIG. 21, the projections 1056 produce a "scraping," or "tearing," action on the respective adjacent block surfaces, thereby creating an irregularly roughened surface for those sides of the blocks. A horizontally extending screed 1086 (FIG. 22) can be provided at the bottom edge of the end walls 1002, 1004 and the plates 1012, 1014. Each screed desirably extends horizontally a distance approximately equal to the height of the projections 1056. The screed functions to flatten or smooth out any high points on the adjacent block surface as the mold moves vertically relative to the blocks.

As shown in FIGS. 21-23, the projections 1056 desirably taper as they extend outwardly from the wall 1002. In the illustrated embodiment, for example, each projection 1056 is generally "frust-pyramidal" in shape, that is, each projection 1056 has a square-shaped base 1066 at the surface 1032 of the wall, a flattened, square-shaped end surface or crest 1068 spaced from the base 1066, and four flat side surfaces 1058, 1060, 1062 and 1064 that converge as they extend from the base 1066 to the end surface 1068. However, it is contemplated that other tapered or non-tapered shapes may be used for the projections 1056. For example, the projections may be pyramidal, conical, frust-conical, rectangular, square, cylindrical, or any of other various shapes.

Figure 26:
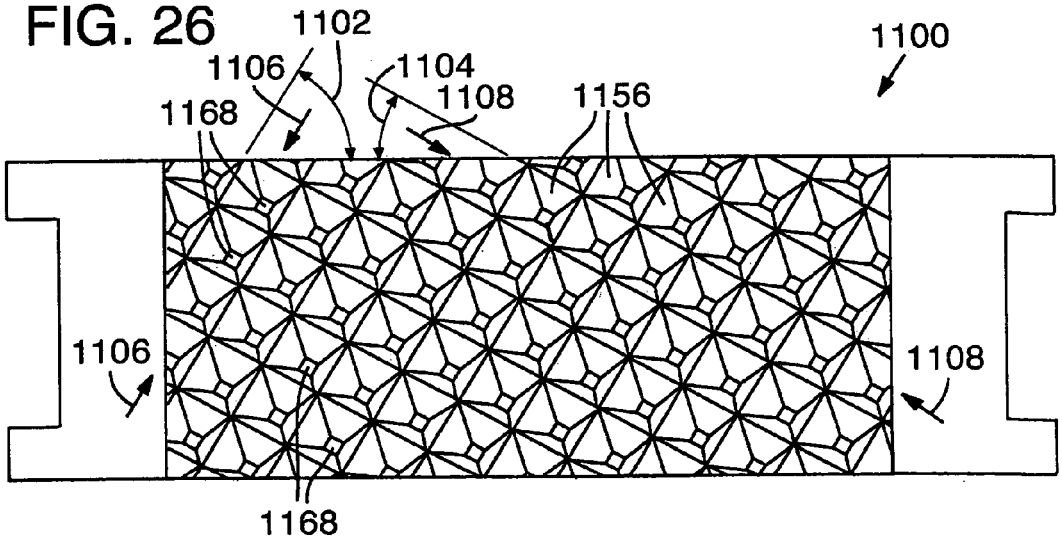
FIG. 26 is a front elevational view of a mold wall for creating a roughened surface texture on a block surface, according to another embodiment.

Desirably, the projections 1056 are distributed uniformly throughout the surface area of the interior surface 1032, except at side portions 1040 and 1042 that abut against the mold inserts 1018, 1020 (FIG. 20). As best shown in FIG. 21, the projections 1056 desirably are arranged side-by-side in diagonal rows (with the base 1066 of each projection sharing a common side with an adjacent projection) extending across the surface 1032 without spacing between projections or between adjacent rows of projections. In the illustrated embodiment, the diagonal rows extend at 45 degree angles with respect to the edges of the wall. However, in other embodiments (such as shown in FIG. 26, described below), the projections can be arranged in rows that form angles that are less than or greater than 45 degrees with respect to the edges. Arranging the projections in diagonally extending rows minimizes the retention of block-forming material on the end wall 1002 and maximizes contact between the projections and the adjacent block surface to achieve a consistent texture across the surface.

In other embodiments, the rows of projections 1056 may extend horizontally across the first surface so as to form a "checkerboard" pattern of projections. In addition, in other embodiments, the projections 1056 may be spaced apart in the direction of the rows of projections. In still other embodiments, the rows of projections may be spaced from each other.

As shown in FIG. 21 and except for those projections bordering side portions 1040, 1042 of the interior surface 1032, the base 1066 of each projection 1056 adjoins the base 1066 of an adjacent projection to minimize spacing between the crests 1068 of adjacent projections. The side surfaces 1058, 1060 of each projection 1056 face in a generally upward direction and the side surfaces 1062, 1064 of each projection 1056 face in a generally downward direction. Thus, it can be seen that the side surfaces 1058, 1060, along with the end surface or crest 1068, of each projection 1056 produce the scraping action against the adjacent surface of a large block in the first mold cavity as the mold 1000 is moved vertically with respect to the block in the direction of arrow A.

In the illustrated embodiment, the side surfaces 1058, 1060 of the projections 1056 have slopes that are less than the slopes of the side surfaces 1062, 1064. This minimizes the likelihood of fill material being retained in the spaces between adjacent projections as the block is being removed from the mold cavity. In other embodiments, the side surfaces of each projection can be oriented at the same angle with respect to the interior surface 1032.

The wall 1002 and the projections 1056 can have a unitary, monolithic construction, and may be formed by machining the projections 1056 into one surface of a piece of material used to form the wall. The end wall 1004 and plates 1012, 1014 can be made in a similar manner. In one specific and exemplary implementation, the projections 1056 are machined in a ½ inch thick piece of material (e.g., steel) to a depth of about ¼ inch. The width of each projection is about 0.87 inch at their respective bases 1066 and about 0.19 inch at their respective end surfaces 1068.

In other embodiments, the projections may be separately formed and then coupled or otherwise mounted to the mold wall, such as by welding or with conventional releasable fasteners (e.g., bolts). If releasable fasteners are used, projections that are worn-out can be removed and replaced with new projections.

In still other embodiments, the end walls 1002, 1004 can be used as "inserts" that are attached to the flat end walls of an existing mold. Similarly, the plates 1012, 1014 can be used as inserts that are attached to an existing divider wall of a mold.

In one specific and exemplary implementation, the mold 1000 has a length L (FIG. 20) of about 24 inches extending between the interior surfaces 1032, 1034 of the end walls, and a width W of about 18 inches extending between the interior surfaces of the side walls 1006, 1008. These dimensions allow the mold 1000 to be used with a standard size block-forming machine, such as commonly used to form three, 8 inch×8 inch×16 inch concrete building blocks. Notably, the small, medium, and large blocks formed from the mold cavities 1026, 1028, 1030 have a minimum depth (the dimension extending between the first and second faces of a block) of at least 11.5 inches, and more preferably, at least 12 inches, and hence are suitable for constructing walls up to at least 4 feet in height without geogrid. In contrast, conventional molding techniques cannot be used to form blocks of this size in a standard size mold because either sacrificial portions must be molded to the blocks or additional concrete must be retained in the mold to form the roughened surfaces of each block. Unlike conventional techniques, the mold 1000 is used to form roughened surfaces on two opposing faces of each block without retaining concrete in the mold and without forming any sacrificial portions on the blocks. The height of the mold 1000 can vary and depends on the final desired height of the blocks.

The mold 1000 may be adapted for use with any conventional block-forming machine, such as those available from Columbia Machine (Vancouver, Wash.), Masa-USA, LLC (Green Bay, Wis.), Knauer Engineering (Germany), Besser, Inc. (Alpina, Mich.), Tiger Machine (Japan), or Hess Machinery (Ontario, Canada), to name a few.

Figure 24:
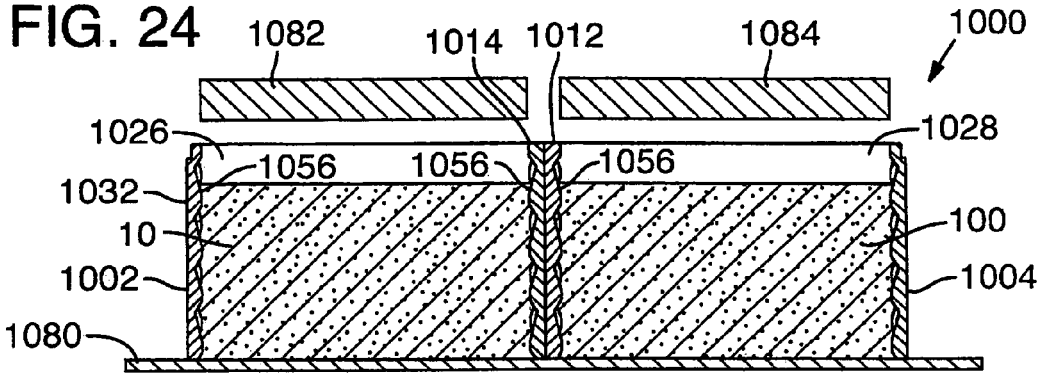
FIG. 24 is a schematic, vertical sectional view of the mold of FIG. 21 illustrating a method for forming a small, medium, and large block with the mold.

Referring to FIG. 24, a method for using the mold 1000 for forming a small, medium, and large block, according to one embodiment, will now be described. As shown, the mold 1000 can be supported on a pallet 1080 or other support. To further minimize the retention of concrete in the mold, a concrete release agent can be applied to the interior surfaces 1032, 1034, 1036, 1038.

The mold 1000 and the pallet 1080 can be moved into place under a first pusher plate (commonly known as the mold head), or stripper shoe, 1082, a second pusher plate, or stripper shoe, 1084, and a third pusher plate, or stripper shoe (not shown), such as by way of a conveyor (not shown). Forms (not shown) for forming the pin holes in each block can be inserted into the mold cavities 1026, 1028, 1030. The forms can be supported by bars (not shown) that extend transversely across the open top of the mold 1000 and are supported by the side walls 1006, 1008 of the mold, as known in the art.

The first pusher plate 1082 is shaped so as to be able to fit slidably within the first mold cavity 1026, the second pusher plate 1084 is shaped so as to be able to fit slidably within the second mold cavity 1028, and the third pusher plate (not shown) is shaped so as to be able to fit slidably within the third mold cavity 1030. The pusher plates may be coupled to any suitable mechanism for moving the pusher plates between raised and lowered positions and for pressing the pusher plates against the top surface of the blocks in the mold cavities. For example, the pusher plates may be coupled to a hydraulic ram, as generally known in the art.

The mold cavities 1026, 1028, 1030 are loaded with a flowable, composite cementitious fill material through the open top of the mold. Composite fill material generally comprises, for example, aggregate material (e.g., gravel or stone chippings), sand, mortar, cement, and water, as generally known in the art. The fill material also may comprise other ingredients, such as pigments, plasticizers, and other fill materials, depending upon the particular application.

The mold 1000, or the pallet 1080, or a combination of both, may be vibrated for a suitable period of time to assist in the loading of the mold with fill material. The pusher plates are then lowered into the mold cavities 1026, 1028, 1030, against the top of the mass of fill material in each cavity. The pusher plates desirably are sized so as to provide a slight clearance with the projections 1056 when lowered into the mold cavities. Additional vibration, together with the pressure exerted by the pusher plates acts to densify the fill material and form the final shape of the blocks.

Figure 25:
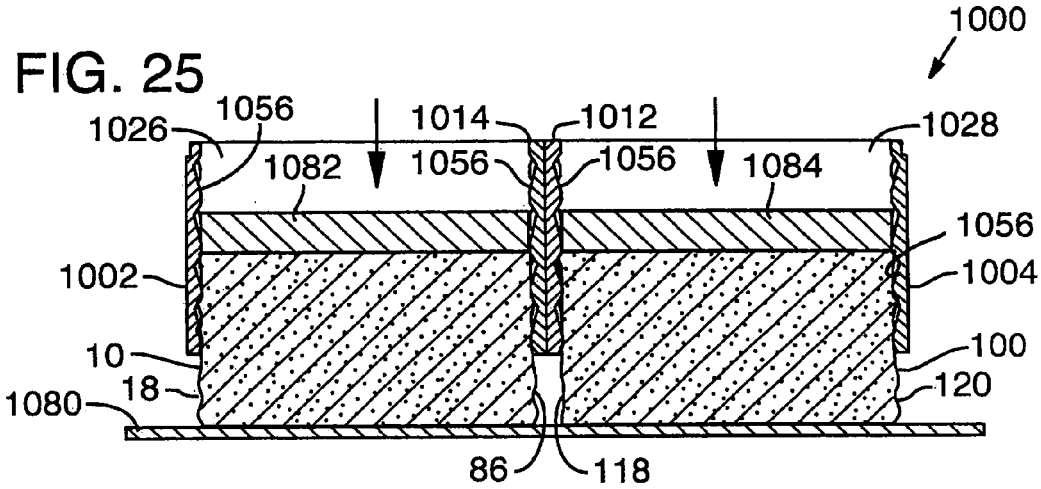
FIG. 25 is a schematic, vertical sectional view similar to FIG. 24 showing blocks being removed from the mold.

After a large block 10, a medium block 100, and a small block 200 are formed in the mold cavities, the blocks, in an uncured state, are removed from the mold such as by raising the mold 1000 (as indicated by arrow A in FIG. 25), while maintaining the vertical position of the pusher plates and the pallet 1080 so that the blocks are pushed through the open bottom of the mold 1000. As the mold moves upwardly relative to the uncured blocks, the projections 1056 pass upwardly through the uncured concrete as the concrete flows around the projections.

Alternatively, the blocks can be pushed through the mold 1000 by moving the pusher plates through the respective mold cavities, while simultaneously lowering the pallet and maintaining the vertical position of the mold 1000. In either case, the action of stripping the blocks 10, 100, 200 from the mold 1000 creates a roughened surface texture on the first and second faces of each block. Since the mold is not configured to retain fill material for the purpose of creating the roughened surfaces of the block, unlike some prior art devices, the mold 1000 does not require frequent stoppages in production to clear material from the walls of the mold.

Additionally, because the projections 1056 do not retain fill material as the blocks are stripped from the mold, the blocks maintain their dimensional tolerances. Thus, the roughened surfaces of each block (e.g., the first and second faces 18, 20 of the large block 10) will be substantially perpendicular to the block upper and lower surface, and each block will have a substantially constant cross-sectional profile from top to bottom.

The mold filling time, the vibration times and the amount of pressure exerted by the pusher plates are determined by the particular block-forming machine being used, and the particular application. After the small, medium, and large blocks are removed from the mold, they may be transported to a suitable curing station, where they can be cured using any suitable curing technique, such as, air curing, autoclaving, steam curing, or mist curing. The foregoing cycle can then be repeated to form another small, medium, and large block using the mold 1000.

An advantage of the foregoing method is that it minimizes waste material in at least two ways. First, the blocks do not have to be formed with any sacrificial portions (which typically are about 2 inches thick) that are subsequently removed to form split faces on the blocks. Second, the interior mold surfaces having projections 1056 are designed to minimize the retention of block-forming material in the mold as the uncured blocks are removed from the mold. Thus, the amount of waste material is significantly reduced compared to conventional techniques that are used to form roughened surfaces on blocks.

FIG. 26 illustrates a mold wall 1100, according to another embodiment, for creating a roughened surface texture on a block surface. The wall 1100 can be used, for example, in lieu of the end wall 1002 in the mold 1000 (FIGS. 20, 21). The wall 1100 is formed with a plurality of projections 1156 arranged in rows extending diagonally across the surface of the wall. The wall 1100 has the same construction as the wall 1002 (FIGS. 20-23), except that the diagonal rows of projections 1156 extend at angles less than or greater than 45 degrees with respect to the edges of the wall. As shown, the rows extending upwardly left to right, such as row 1106, form an angle 1102 with respect to the upper edge of the wall, and the rows extending upwardly right to left, such as row 1108, form an angle 1104 with respect the upper edge of the wall. Consequently, the crests 1168 of the projections 1156, unlike the projections 1053 of FIG. 21, are not vertically aligned from the upper edge to the lower edge of the wall. Advantageously, this provides for a more consistent surface texture on the face of a block. The end wall 1004 and the plates 1012 and 1014 (FIG. 20) also can be provided with projections 1156 that are arranged in the manner shown in FIG. 26.

In particular embodiments, for example, the rows extending upwardly left to right, such as row 1106, are oriented at an angle of about 60 degrees with respect to the wall upper edge, and the rows extending upwardly right to left, such as row 1108, form an angle of about 30 degrees with respect the wall upper edge.

The invention has been described with respect to particular embodiments and modes of action for illustrative purposes only. The present invention may be subject to many modifications and changes without departing from the spirit or essential characteristics thereof. I therefore claim as our invention all such modifications as come within the scope of the following claims.

We claim:

1. A mold for making a small, medium, and large block having substantially the same depth but having different lengths, the mold comprising:

a plurality of walls defining a first cavity for molding the large block, a second cavity for molding the medium block, and a third cavity for molding the small block, wherein the cavities are separated from each other by one or more of said walls, and wherein each cavity has at least two opposing inner surfaces that are adapted to form a roughened texture on adjacent surfaces of the blocks as the blocks are removed from the cavities;

wherein the small, medium, and large blocks can be used together to construct a block wall;

wherein the plurality of walls comprises opposed, first and second end walls, opposed, first and second side walls extending between respective ends of the end walls, a first divider wall extending between the first and second side walls and dividing the mold into a first mold portion comprising the first cavity and a second mold portion comprising the second and third cavities, and a second divider wall extending between the first end wall and the first divider wall and dividing the second mold portion into the second and third cavities;

wherein each of said inner surfaces that is adapted to form a roughened texture on an adjacent block surface has a plurality of tapered projections extending therefrom, the projections being configured to contact adjacent surfaces of the blocks and form a roughened texture resembling a split block face thereon as the blocks are removed from the mold;

wherein each of said inner surfaces that is adapted to form a roughened texture on an adjacent block surface comprises a plurality of grooves defining rows of projections and is characterized by a ratio of the projected area of the inner surface to the total projected area of the grooves being less than 2:1.

2. The mold of claim 1, wherein the small, medium, and large blocks are substantially the same shape.

3. The mold of claim 1, wherein the depth of each block is greater than 10.25 inches.

4. The mold of claim 3, wherein the depth of each block is at least about 11.5 inches or greater.

5. The mold of claim 1 wherein the mold has a length of about 24 inches extending between the inside surfaces of the end walls and a width of about 18 inches extending between the inside surfaces of the side walls.

6. The mold of claim 1 wherein the projections are pyramidal or frusta-pyramidal in shape.

7. The mold of claim 1, wherein:

the large block has a first face that is about 16 inches in length and an opposing second face that is about 14 inches in length;

the medium block has a first face that is about 12 inches in length and an opposing second face that is about 10 inches in length; and the small block has a first face that is about 6 inches in length and an opposing second face that is about 4 inches in length.

8. The mold of claim 7, wherein the depth of each block is at least about 11 inches or greater.

* * * * *